US005154422A

United States Patent [19]

Highsmith, Sr. et al.

[11] Patent Number: 5,154,422

[45] Date of Patent: Oct. 13, 1992

[54] LOTTERY NUMBER CHECKING TEMPLATE

[75] Inventors: James L. Highsmith, Sr.; Jebran M. Sarji, both of Charlotte, N.C.

[73] Assignee: Lottery Card Reader, Inc., Charlotte, N.C.

[21] Appl. No.: 824,065

[22] Filed: Jan. 23, 1992

[51] Int. Cl.[5] ..... A63F 3/06

[52] U.S. Cl. ..... 273/148 R; 273/285

[58] Field of Search ..... 273/148 R, 269, 285, 273/286; 283/49, 48.1

[56] References Cited

U.S. PATENT DOCUMENTS

| | | | |
|---|---|---|---|
| 4,064,206 | 12/1977 | Seufert | 264/26 |
| 4,179,252 | 12/1979 | Seufert | 425/174.6 |
| 4,348,449 | 9/1982 | Seufert | 428/167 |
| 4,607,845 | 8/1986 | Gallo | 273/148 R |
| 4,613,040 | 9/1986 | Morris et al. | 273/285 |
| 4,752,073 | 6/1988 | Thompson | 273/148 R |
| 4,781,379 | 11/1988 | Parks | 273/148 R |
| 4,852,268 | 8/1989 | Sutherland et al. | 33/562 |

FOREIGN PATENT DOCUMENTS

| | | | |
|---|---|---|---|
| 2412327 | 8/1979 | France | 273/269 |
| 2429028 | 2/1980 | France | 273/148 R |

*Primary Examiner*—Benjamin H. Layno
*Attorney, Agent, or Firm*—Bell, Seltzer, Park et al.

[57] ABSTRACT

A lottery checking template having a bottom panel and a top panel joined at an integrally formed fold line. The bottom panel has printed indicia thereon of an arrangement of the lottery numbers that are playable in the lottery game corresponding to the arrangement of numbers on a lottery betting slip. The top panel has a transparent window portion overlying the indicia of the lottery numbers playable when the bottom and top panels are folded together in superposed relation. Accordingly, the announced winning lottery numbers may be removably marked on the transparent window portion of the top panel. A lottery ticket betting slip may be inserted into the template and the numbers marked thereon compared to the marked winning numbers. The top and bottom panels of the template may include opposing lengthwise extending ridges adjacent the fold line defining an abutment for engaging the lower edge of the lottery ticket betting slip to prevent pinching at the fold line. The top and bottom panels may also include corresponding cutaway edge portions extending lengthwise opposite the fold line to facilitate manipulation of the lottery betting slip within the template.

15 Claims, 2 Drawing Sheets

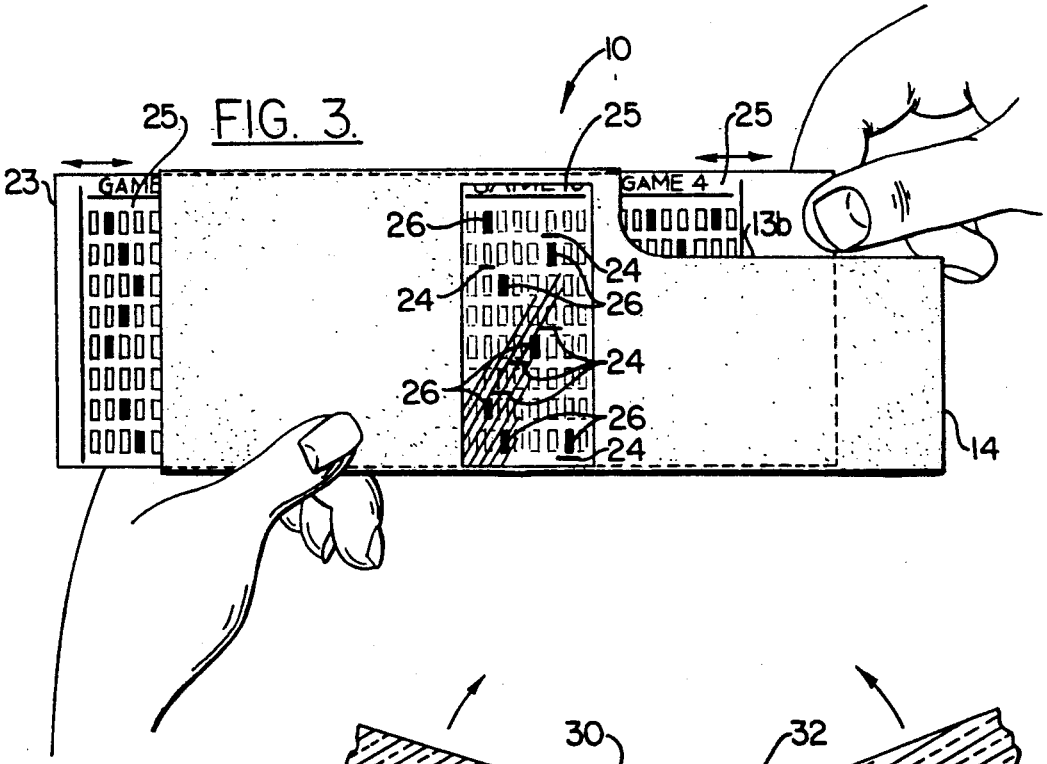
FIG. 3.
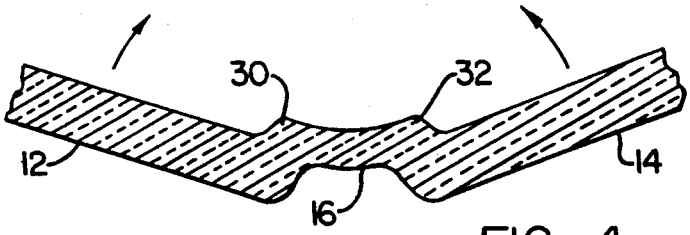
FIG. 4.
FIG. 5.
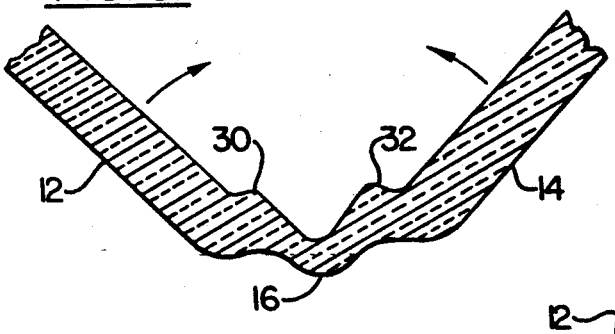
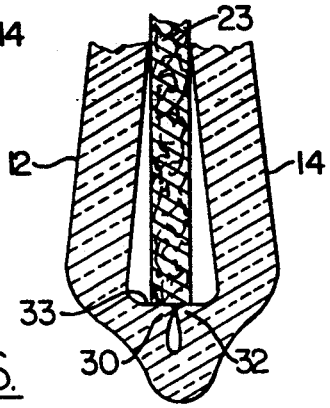
FIG. 6.

LOTTERY NUMBER CHECKING TEMPLATE

FIELD OF THE INVENTION

The present invention relates to the field of lottery games, and more particularly, to a template for checking lottery ticket betting slips that are marked by a lottery game player.

BACKGROUND OF THE INVENTION

State sponsored lottery games have become increasingly popular. In fact, the majority of states in the United States now offer one or more lottery games to their residents.

One type of lottery game that is essentially popular allows the player to select his own ticket numbers. This is done by making available to the player a lottery ticket betting slip typically including multiple arrangements of the sequence of numbers playable in the lottery game. The desired numbers are marked on the betting slip, such as by darkening a rectangular or oval area surrounding the desired number. Typically, an optical reader at the point of sale then optically reads the betting slip and produces printed lottery tickets therefrom, each ticket bearing the sequence of numbers being played. The betting slip and the printed tickets produced therefrom are retained by the player.

Many lottery game players often purchase a large number of tickets with a different selection of numbers on each ticket. Accordingly, such a player is faces with the somewhat difficult task of comparing each set of numbers on the printed lottery ticket with the announced winning sequence of lottery numbers. Since only the numbers played are typically printed on the lottery tickets, considerable care and patience is required by the player to check each and every number on each and every printed ticket. Thus, quick scanning to verify a winning combination of numbers on the printed lottery tickets is not readily possible. More importantly, the fear of potentially failing to identify a winning lottery ticket will induce most lottery players to check and recheck tickets for the winning combination of numbers.

An alternative approach to checking each number on the printed lottery tickets is to check the lottery ticket betting slips marked by the player for purchasing the lottery tickets. The player has already marked on the lottery ticket betting slip the numbers played out of the arrangement of numbers playable. Since the numbers played are marked from the entire sequence of numbers playable, the lottery ticket betting slip may be checked for the winning combination of numbers using a checking template. For example, U.S. Pat. No. 4,607,845 to Gallo discloses a lottery number checking template formed of a single blank of transparent plastic folded into three panels. The top panel has the set of lottery numbers printed thereon as used on the lottery ticket betting slip. The winning numbers may be marked on the transparent front panel and the lottery ticket betting slip having the numbers to be checked is passed through a sleeve formed by the three folded panels. The numbers played as indicated on the betting slip may thus be compared to the announced winning number combination.

U.S. Pat. No. 4,781,379 to Parks discloses a folding wallet for storing and for checking lottery tickets. The folding wallet includes a rectangular window for inserting a lottery ticket betting slip having the winning combination of numbers previously marked thereon. The transparent sheet of the window is then marked with a pen to indicate the winning numbers, such as by circling the winning numbers. The numbers played on the betting slip may thus be compared to the winning number combination.

U.S. Pat. No. 4,752,073 discloses a lottery card reader for checking a winning combination of numbers having a body including a slot therein which is transpierced by an array of passages corresponding to the array of numbers. Each passage contains an opaque slider which may be shifted between opposite ends of the passage prior to insertion of a lottery ticket to check for a winning combination of lottery numbers.

U.S. Pat. No. 4,852,268 to Sutherland et al. discloses a template for marking multiple lottery ticket betting slips each with the same sequence of numbers. The template has two stiff sheets joined along a fold line. The front sheet is transparent and includes a series of perforated portions in locations corresponding to the sequence of numbers available. Desired ones of the perforated portions may be readily removed to assist a lottery player in completing multiple betting slips each having identical numbers marked thereon. To use the template, a lottery betting slip is inserted into the template with the edge engaged fully into the fold line.

Despite a number of lottery checking templates and devices, there still exists a need for a checking template which is inexpensive, yet which permits ready manipulation of a lottery betting slip and checking of the numbers played as marked thereon. It is also desirable that a template ensure that the lottery ticket betting slip is accurately positioned within the template so that the winning combination of lottery numbers can be accurately and quickly compared to the winning number combination.

SUMMARY OF THE INVENTION

In view of the foregoing background, it is therefore an object of the present invention to provide an improved template for readily checking one or more lottery ticket betting slips to determine if a winning lottery ticket has been played.

It is another object of the present invention to provide an improved template ensuring the accurate positioning of the lottery ticket betting slip within the template, yet permitting ready manipulation of the lottery ticket betting slip within the template.

These and other objects according to the invention are provided by a lottery checking template including a generally rectangular plastic bottom panel and a generally rectangular plastic top panel of preferably the same size and joined together at respective lengthwise extending edges thereof by an integrally molded fold line. The fold line permits the two panels to be folded in superposed relation. The bottom and top panels of the template are preferably formed of a sheet of flexible transparent plastic material, such as polyvinyl chloride.

The bottom panel includes printed indicia thereof of an arrangement of numbers corresponding to the arrangement of lottery numbers playable on the lottery ticket betting slip. The top panel includes a transparent window portion to permit viewing of the underlying printed indicia of the arrangement of numbers on the bottom panel when the two panels are folded in superposed relation.

The transparent window portion of the top panel has an outer surface to permit the player to removably mark the location of the winning lottery numbers thereon corresponding to the location of the winning lottery numbers on the underlying arrangement of numbers of the bottom panel. The window portion is preferably defined by two generally rectangular spaced apart areas having an opaque coating thereon. Thus, the transparent window portion is preferably formed in a medial portion of the top panel.

In addition, the top and bottom panels have opposing ridges adjacent the fold line defining an abutment for engaging the lower edge of the lottery ticket betting slip. The abutment permits the lottery ticket betting slip to be readily manipulated within the template without being pinched at the fold line. Thus the ridges facilitate manipulation of the lottery ticket betting slip when positioned within the template so that the lottery numbers played are readily checked against the winning lottery numbers indicated by the removable markings on the outer surface of the transparent window portion of the top panel.

Each of the top and bottom panels may also have corresponding cutaway edge portions extending lengthwise along respective free edges thereof opposite the fold line. The cutaway edge portions extend from a medial portion of the panels to an edge thereof adjacent the fold line. The cutaway edge portions facilitate gripping and manipulation of the lottery ticket betting slip when positioned within the lottery checking template.

The integrally molded fold line preferably has a thickness less than the thickness of the bottom and top panels to permit the panels to be folded in superposed relation substantially free of spring-back bias. The thickness of the plastic material at the integrally molded fold line is preferably in the range of about 30–60% of the thickness of the bottom and top plastic panels. The plastic material displaced from the fold line forms the opposing ridges adjacent the fold lines as described above.

BRIEF DESCRIPTION OF THE DRAWINGS

FIG. 3 is a side elevational view of the lottery number checking template as shown in FIG. 1 with the top and bottom panels in superposed relation with a lottery ticket betting slip positioned therebetween.

FIGS. 4 and 5 are greatly enlarged cross-sectional views of the fold line portion of the lottery checking template as shown in FIG. 1 with the template in the nearly fully opened position and partially folded position, respectively.

FIG. 6 is a greatly enlarged cross-sectional view of the fold line portion of the lottery number checking template as shown in FIG. 1 in the folded position with a lottery ticket betting slip positioned therein.

DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiment set forth herein. Rather, applicant provides this embodiment so that this disclosure will be thorough and complete, and will fully convey the scope of the invention to those skilled in the art. Like numbers refer to like elements throughout.

Figure 1:
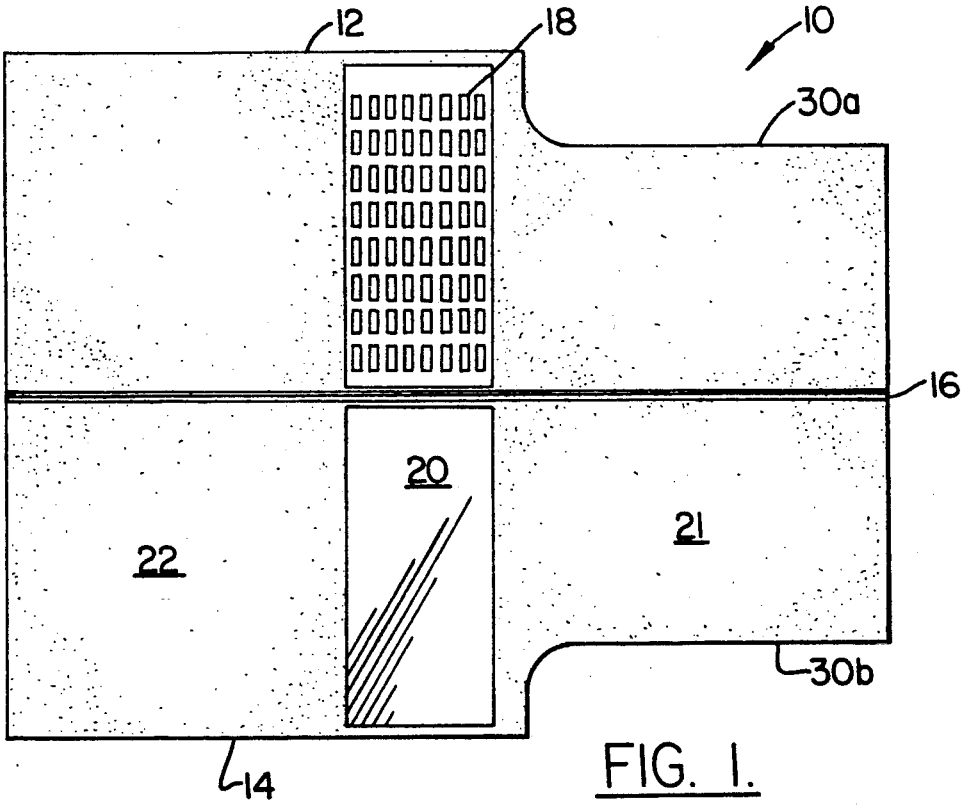
FIG. 1 is a plan view of the lottery number checking template according to the present invention shown in the fully opened position.
Figure 2:
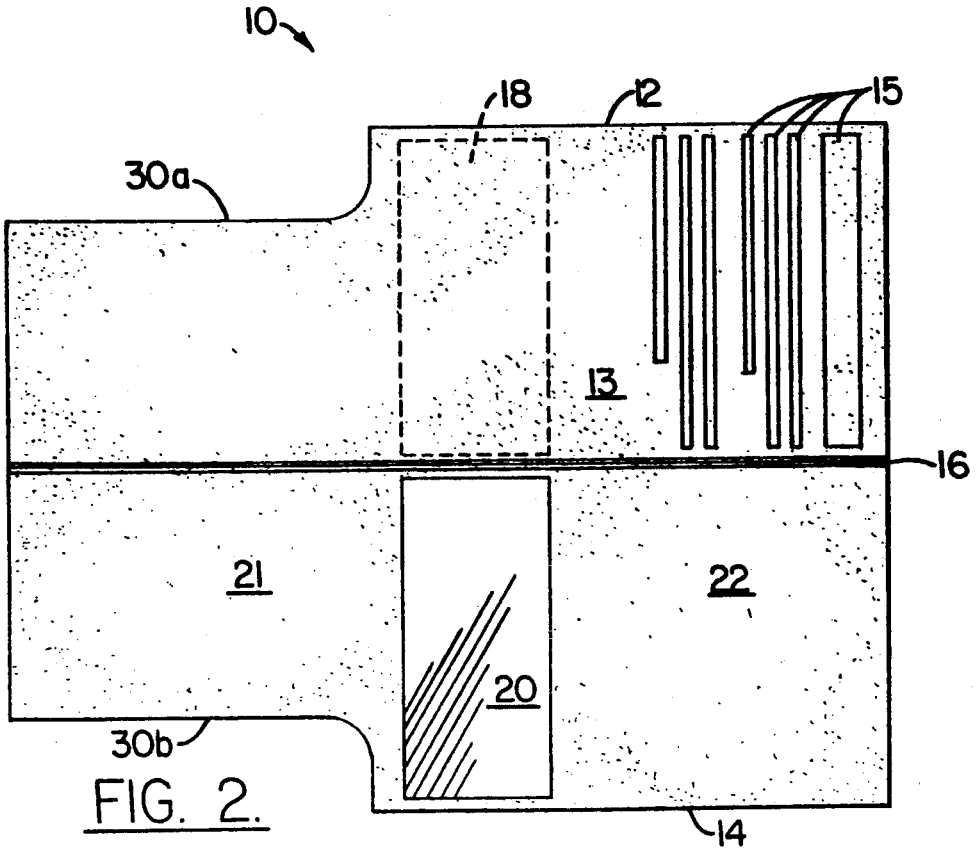
FIG. 2 is a bottom view of the lottery number checking template as shown in FIG. 1.

Referring to FIGS. 1 and 2, there is shown the lottery checking template according to the present invention generally designated by reference numeral 10. The template 10 includes a bottom panel 12 and a top panel 14 joined together by an integrally molded fold line 16, as described more fully below. The bottom panel 12 and top panel 14 are preferably formed from a single sheet of transparent flexible plastic. Polyvinyl chloride having a thickness of about 0.014 inches is a preferred plastic material. As shown in the illustrated embodiment, the bottom panel 12 and the top panel 14 are preferably generally rectangular in shape and are each of substantially the same size.

The inner surface of the bottom panel 12 includes printed indicia of an arrangement of the lottery numbers playable 18 corresponding to the numbers playable on a lottery ticket betting slip 23 (FIG. 3). The top panel 14 includes a transparent window portion 20 defined between two generally rectangular spaced apart areas of an opaque coating 21, 22 on the inner or outer surface of the top panel 14.

The back surface of the bottom panel 12 (FIG. 2) may also preferably include an opaque coating 13 thereon. Printed indicia of the lottery template instructions 15 are preferably included on the opaque coating 13. The opaque coating 13 prevents the instructions 15 form interfering with the viewing and recognition of the printed indicia of the arrangement of lottery numbers playable 18 on the bottom panel 12.

The operation of the lottery checking template 10 according to the present invention is best understood with reference to FIG. 3. After the winning combination of lottery numbers is announced, these numbers are identified on the transparent window portion 20 of the top panel 14 by underlining marks 24, or other markings, made with a removable marker. The location of the winning numbers for marking of the top panel 14 is readily determined by viewing the underlying printed indicia of the arrangement of lottery numbers playable 18 through the transparent window portion 20 of the top panel 14. As would be readily understood by those skilled in the art, conventional dry-erase or damp-erase ink pens may be used on the outer surface of the transparent window portion 20 to removably mark the locations of the winning lottery numbers.

After the transparent window portion 20 is marked by the underlying marks 24, a lottery ticket betting slip 23, previously used to purchase the lottery tickets, is inserted into the template 10. An arrangement of numbers played 25 on the lottery ticket betting slip 23 is aligned with the transparent window portion 20 as shown in FIG. 2. Where the underlining marks 24 align with a marked number 26 on the betting slip 23, a match is thereby indicated. Each arrangement of numbers played 25 on the lottery ticket betting slip 23 may be quickly and easily checked using the lottery checking template 10 according to the invention. If the underlining marks 24 match with all, or a designated number, of the numbers marked 26 on the betting slip 23 for an arrangement of numbers played 25, then a winning lottery ticket is indicated.

The betting slip 23 may be readily manipulated within the lottery checking template 10 according to the present invention to thereby ensure that all of the numbers played may be quickly and easily checked. Referring again to FIGS. 1 and 3, cutaway edge portions 13*a*, 13*b* are provided on both the bottom panel 12 and top panel 14, respectively. The cutaway edge portions 13*a*, 13*b* are located on the free edges of the bottom panel 12 and top panel 14, respectively, opposite the integrally molded fold line 16. The cutaway edge portions 13*a*, 13*b* extend lengthwise from a medial portion of the bottom panel 12 and top panel 14, respectively, to the ends thereof. As shown best in FIG. 3, the cutaway edge portions 13*a*, 13*b* of the template 10 permit grasping of the batting slip 23 by the thumb and index finger of the player so that the betting slip can be readily positioned and repositioned within the template 10 as successive arrangements of numbers 25 thereon are quickly and accurately checked.

A further advantageous feature of the present invention is the integrally molded folded line 16 as shown in greater detail in FIGS. 4 through 6. The fold line 16 is similar to that described in U.S. Pat. No. 4,348,449 to Seufert entitled *Apparatus for Forming Flexible Fold Lines in Thermoplastic Sheets and Article So Formed,* the disclosure of which is hereby incorporated herein by reference. As shown, the fold line 16 is formed by a reduced thickness of plastic material in the range of about 30–60% of the thickness of the bottom panel 12 and the top panel 14. The thus formed integrally molded fold line 16 permits the bottom panel 12 and top panel 14 to be readily folded in superposed relation substantially free of any spring-back bias.

As also shown in FIGS. 4–6, lengthwise extending opposing ridges 30, 32 are integrally molded on the bottom panel 12 and top panel 14, respectively, adjacent the fold line 16. The ridges 30, 32 are formed as material is displaced during formation of the fold line 16. As shown best in FIG. 6, the ridges 30, 32 define an abutment 33 for engaging the lower edge of the lottery betting slip 23, thereby preventing the lottery betting slip from being pinched or bound at the fold line 16. The lottery ticket betting slip 23 may thus be readily manipulated within the template 10 to check the lottery numbers played against the winning lottery number combination.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A template for use in checking winning lottery numbers against numbers played as marked on a lottery ticket betting slip, the lottery ticket betting slip including printed indicia of one or more arrangements of lottery numbers playable and player markings thereon indicating the respective numbers played, said template comprising:

a generally rectangular plastic bottom panel and a generally rectangular plastic top panel joined together at respective lengthwise extending edges thereof by a fold line, said fold line permitting said bottom and top panels to be folded in superposed relation;

printed indicia on said bottom panel of an arrangement of numbers corresponding to the arrangement of lottery numbers playable on the lottery ticket betting slip;

a transparent window portion in said top panel to permit viewing of the underlying printed indicia of the arrangement of lottery numbers playable when said bottom and top panels are folded in superposed relation, said transparent window portion having an outer surface to permit the player to removably mark the location of the winning lottery numbers thereon corresponding to the location of the winning lottery numbers on the underlying printed indicia of the arrangement of lottery numbers playable; and opposing lengthwise extending ridges on the inner surface of said bottom and top panels adjacent said fold line, said ridges defining an abutment for engaging the lower edge of the lottery ticket betting slip and for permitting same to be readily manipulated within the template without being pinched at the fold line so that the lottery numbers played are readily checked against the winning lottery numbers indicated by the removable markings on the outer surface of said transparent window portion of said top panel.

2. The template according to claim 1 wherein said bottom and top panels are formed of a sheet of flexible transparent plastic material.

3. The template according to claim 2 wherein said fold line is integrally molded with said bottom and top panels.

4. The template according to claim 3 wherein said integrally molded fold line has a thickness less than the thickness of said bottom and top panels for permitting same to be folded in superposed relation substantially free of spring-back bias at the fold line.

5. The template according to claim 4 wherein the thickness at said fold line is in the range of about 30 percent to 60 percent of the thickness of said bottom and top panels.

6. The template according to claim 1 wherein said bottom and top panels each have corresponding cutaway edge portions extending lengthwise along respective free edges thereof opposite said fold line; and wherein said cutaway edge portions extend from a medial portion of said bottom and top panels to an edge thereof adjacent said fold line to facilitate gripping and manipulation of the lottery ticket betting slip when positioned within said template.

7. The template according to claim 1 wherein said top and bottom panels are of substantially the same size.

8. The template according to claim 1 further comprising two generally rectangular spaced apart opaque areas on said top panel defining said transparent window portion therebetween in a medial portion of said top panel.

9. The template according to claim 1 further comprising printed indicia on at least one of said top panel and said bottom panel of the instructions for using said template.

10. A template for use in checking winning lottery numbers against numbers played as marked on a lottery ticket betting slip, the lottery ticket betting slip including printed indicia of one or more arrangements of lottery numbers playable and player markings thereon indicating the respective numbers played, said template comprising:

a generally rectangular bottom panel and a generally rectangular top panel joined together at respective lengthwise extending edges thereof by a fold line, said fold line permitting said bottom and top panels to be folded in superposed relation;

printed indicia on said bottom panel of an arrangement of numbers corresponding to the arrangement of lottery numbers playable on the lottery ticket betting slip; and a transparent window portion in said top panel to permit viewing of the underlying printed indicia of the arrangement of lottery numbers playable when said bottom and top panels are folded in superposed relation, said transparent window portion having an outer surface to permit the player to removably mark the location of the winning lottery numbers thereon corresponding to the location of the winning lottery numbers in the underlying printed indicia of the arrangement of lottery numbers playable;

said bottom and top panels each having corresponding cutaway edge portions extending lengthwise along respective free edges thereof opposite said fold line, said cutaway edge portions extending from a medial portion of said bottom and top panels to an edge thereof adjacent said fold line to facilitate gripping and manipulation of the lottery ticket betting slip when positioned within said template so that the lottery numbers played are readily checked against the winning lottery numbers indicated by the removable markings on said outer surface of said transparent window portion of said top panel.

11. The template according to claim 10 wherein said bottom and top panels are formed of a sheet of flexible transparent plastic material.

12. The template according to claim 11 wherein said plastic material is polyvinyl chloride having a thickness of about 0.014 inches.

13. The template according to claim 10 wherein said top and bottom panels are of substantially the same size.

14. The template according to claim 10 further comprising two generally rectangular spaced apart opaque areas on said top panel defining said transparent window portion therebetween in a medial portion of said top panel.

15. The template according to claim 10 further comprising printed indicia on at least one of said top panel and said bottom panel of the instructions for using said template.

* * * * *

UNITED STATES PATENT AND TRADEMARK OFFICE

CERTIFICATE OF CORRECTION

PATENT NO. : 5,154,422

DATED : October 13, 1992

INVENTOR(S) : James L. Highsmith, Sr. et al.

It is certified that error appears in the above-identified patent and that said Letters Patent is hereby corrected as shown below:

Column 1, line 30, delete "face" and substitute therefor --faced--.

Column 2, line 61, delete "thereof" and substitute therefor --thereon--.

Column 4, line 31, delete "form" and substitute therefor --from--.

Column 4, line 57, delete "FIG. 2" and substitute therefor --FIG. 3--

Column 5, line 13, delete "batting" and substitute therefor --betting--.

Signed and Sealed this

Twenty-eighth Day of September, 1993

Bruce Lehman

*Attest:*

BRUCE LEHMAN

*Attesting Officer*

*Commissioner of Patents and Trademarks*